US008139999B2

(12) United States Patent
Takagi et al.

(10) Patent No.: US 8,139,999 B2
(45) Date of Patent: Mar. 20, 2012

(54) ADHESIVE APPLICATOR, AND BOOKBINDING AND IMAGE-FORMING APPARATUSES EQUIPPED WITH THE APPLICATOR

(75) Inventors: Katsumasa Takagi, Kofu (JP); Hiroyuki Sorita, Chuo (JP); Norihiro Ohno, Minamikoma-gun (JP); Jun Kondou, Minami Alps (JP); Kazuyuki Kubota, Minamikoma-gun (JP)

(73) Assignee: Nisca Corporation, Minamikoma-gun (JP)

( * ) Notice: Subject to any disclaimer, the term of this patent is extended or adjusted under 35 U.S.C. 154(b) by 877 days.

(21) Appl. No.: 11/849,299

(22) Filed: Sep. 3, 2007

(65) Prior Publication Data

US 2008/0056851 A1 Mar. 6, 2008

(30) Foreign Application Priority Data

Sep. 4, 2006 (JP) ..... JP-2006-239579

(51) Int. Cl.
*G03G 15/00* (2006.01)
*B42C 13/00* (2006.01)
*B42C 9/00* (2006.01)

(52) U.S. Cl. ..... 399/408; 412/13; 412/37

(58) Field of Classification Search ..... 412/37, 412/13, 25; 399/362
See application file for complete search history.

(56) References Cited

U.S. PATENT DOCUMENTS

| | | | | |
|---|---|---|---|---|
| 3,863,596 | A * | 2/1975 | Anderson | 118/667 |
| 3,956,057 | A * | 5/1976 | Jung | 156/578 |
| 5,240,362 | A * | 8/1993 | Nakayama et al. | 412/11 |
| 5,454,680 | A * | 10/1995 | Lazar | 412/41 |
| 5,556,490 | A * | 9/1996 | Tholerus | 156/64 |
| 6,736,918 | B1 * | 5/2004 | Ichikawa et al. | 156/182 |
| 6,805,317 | B1 * | 10/2004 | Andersson et al. | 242/532.3 |
| 7,527,465 | B2 * | 5/2009 | Toyoizumi et al. | 412/37 |
| 2007/0001362 | A1 * | 1/2007 | Tsukui et al. | 270/58.12 |

FOREIGN PATENT DOCUMENTS

JP 2004-114196 A 4/2004

* cited by examiner

*Primary Examiner* — Ren Yan
*Assistant Examiner* — Allister Primo
(74) *Attorney, Agent, or Firm* — Judge Patent Associates

(57) ABSTRACT

A glue container receiving hot-melt adhesive, an applicator roll, an apparatus casing, and disposed therein, a cooling unit and its control unit, for cooling a post-cover-sheet-processed sheaf, are provided. The control unit is configured to halt the cooling unit when adhesive is being applied to a sheaf with the applicator roll, and to actuate it after adhesive application. The control unit: (1) cools the apparatus casing interior by actuating the cooling unit when a sheaf is conveyed toward a glue application position; (2) halts the cooling unit when adhesive is being applied to a sheaf conveyed into the glue application position; and (3) reactivates the cooling unit after adhesive application. Thus controlling the apparatus-internal temperature appropriately in applying a hot-melt adhesive to a sheaf, and binding the sheaf together with a cover, etc. enables secure binding adhesion in a short time frame, without bookbinding defects such as missing leaves.

7 Claims, 7 Drawing Sheets

ADHESIVE APPLICATOR, AND BOOKBINDING AND IMAGE-FORMING APPARATUSES EQUIPPED WITH THE APPLICATOR

BACKGROUND OF THE INVENTION

1. Technical Field

The present invention—involving adhesive applicators and adhesive-applicator-equipped bookbinding apparatuses that sheave sequentially supplied sheets, apply adhesive to a sheet sheaf, and then bind a cover sheet onto the sheaf to encase it—relates to improvements in apparatus-internal ambient temperature control in heating a hot-melt adhesive to melt it, applying the molten adhesive to an endface of a sheet sheaf, and cold-hardening the work after encasement.

2. Description of the Related Art

Widely known among bookbinding apparatuses of this type are in general those that automatically form booklets by stacking and sheaving sheets conveyed out from an image-forming or like apparatus, applying adhesive to the spine endface of a sheet sheaf, and then binding onto the sheaf a cover sheet fed from a path that is different from that of the sheaf. Recently in particular, printing systems that on demand form images onto sheets in an image-forming apparatus, sheave the sheets, then bookbinding-finish the sheet sheaves into booklets by binding a cover sheet together with the sheet sheaf are widely being employed.

Examples of this sort of conventional bookbinding apparatus include the machine proposed in FIG. 2 of Japanese Unexamined Pat. App. Pub. No. 2004-114196, which stacks and sheaves onto a tray sheets conveyed out from an image-forming apparatus, applies adhesive to the spine endface of the sheet sheaf, and then binds a cover sheet together with the sheet sheaf and by hardening the adhesive adheres the cover to the sheaf. Then for the adhesive, the machine is configured with a glue container with a built-in applicator roll, and the adhesive in the container is applied to the sheet sheaves with the applicator roll. Chiefly employed in this implementation is a hot-melt adhesive, in which case the adhesive in solid form is charged into the container, and is melted and liquefied with a heating means and spread on with the applicator roll.

The benefits of a hot-melt adhesive—thus with which the adhesive in solid form at ordinary temperatures is heat-liquefied and applied to a sheet sheaf, and adheres by hardening after being applied—are that being in solid form facilitates managing the adhesive during handling and storage, and that during use, because the melted-liquefied adhesive after being applied to a sheet sheaf hardens at a leisurely pace, the cover-sheet binding and related processes can be executed in the interim, expediting bookbinding and its associated processes. On the other hand, problems hot-melt adhesives are known to have are that the adhesives must be kept in a heated/melted state inside the bookbinding apparatus, and that if the latter-stage processes on a sheet sheaf to which adhesive has been applied are not implemented within a predetermined post-application time frame, the adhesive hardens, making it impossible to bind the cover sheet together with the sheet sheaf.

Using hot-melt adhesives widely employed to date in binding, as described above, a sheet sheaf and cover sheet together to form booklets in a bookbinding apparatus leads to the following problems. The fact that the viscosity of a melted/liquefied adhesive will be low when the adhesive temperature is high runs the risk of adhesive applied to a sheaf dripping onto and soiling the cover sheet disposed directly underneath, or soiling the apparatus interior, and in some cases, when in subsequent processes a cover sheet is glued on and spine creases are formed, the adhesive leaks out onto the front and back sides of the cover sheet. Meanwhile, if the adhesive temperature is low, the adhesive will not seep in between leaves of the sheaf, on account of which pages may drop out, or the entire spine-covering area of the cover sheet cannot be glued on uniformly. Inasmuch as any of these problems leads to inferior bookbinding, setting the adhesive temperature to an optimal condition is a crucial issue for bookbinding processes.

Therein, as far as adhesive temperature is concerned, cold hardening in a comparatively short time frame after an adhesive has been applied onto and a cover sheet bound together with sheets is called for. Against this backdrop, attempts have been made, as in the patent reference cited earlier (JP 2004-114196), to optimally control the temperature of the adhesive, yet without taking into consideration the temperature inside the glue-container-outfitted apparatus. Consequently, the apparatus-internal temperature, from its relationship to the high-temperature heat that sheets conveyed out from an image-forming or like apparatus take on, and the heating of the glue container in order to melt the hot-melt adhesive, is predisposed to reach high temperatures. The problem with the apparatus-internal temperature becoming elevated is that, with the temperature of the sheets themselves being raised, applied adhesive drips, or more adhesive than necessary penetrates between the sheaf leaves, inviting faulty bookbinding.

Given these circumstances, the present inventors provided a cooling fan within the housing of an apparatus equipped with a glue container, to attempt to keep the apparatus-internal temperature constant and to promote solidification of the adhesive following sheaf encasement. This resolved problems owing to dripping or excessive inter-sheet permeation of adhesive, with the apparatus-internal temperature having gone high on account of the heat that the sheets themselves have taken on. Nevertheless, cooling the apparatus interior with, for example, a cooling device such as a cooling fan caused adhesive that been applied to a sheet sheaf to cool during the interval when the sheaf is transported to the cover-sheet binding position downstream and is bound together with a cover sheet, and this problem was prohibitive of securely gluing on the cover sheets.

BRIEF SUMMARY OF THE INVENTION

A first object of the present invention, brought about taking into consideration the issues discussed above, lies in making available an adhesive applicator that in melting a hot-melt adhesive and applying it to a sheet sheaf, and binding the sheaf together with a cover sheet or the like, controls the apparatus-internal temperature appropriately to enable secure binding adhesion in a short time frame, without bookbinding defects such as missing leaves.

A second object of the present invention lies in making available a bookbinding apparatus, and an image-forming apparatus equipped with the bookbinding apparatus, that enable the bookbinding processes to be done efficiently in collating sheets into a sheaf to create a booklet.

These and other objects and features of the present invention will become clear by the following explanation of embodiments, based on the accompanying drawings.

The present invention employs the following configuration to attain the aforementioned objects.

An adhesive applicator disposed in an adhesive application position in a path that conveys a sheet bundle, that performs the cover sheet binding process with a cover sheet binding means at a downstream side, is equipped with a glue container that contains hot-melt adhesive, an applicator roll disposed in the glue container; an apparatus casing that houses the glue container internally; a cooling means disposed inside the apparatus casing that cools the sheet bundle after the cover sheet has been bonded; and a control means that starts and stops the cooling means. The control means stops the cooling means when adhesive is being applied to the sheet bundle by the applicator roll, and starts the cooling means after the adhesive has been applied by the applicator roll.

The control means is configured to: (1) Cool the inside of the apparatus casing by operating the cooling means when a sheet bundle is conveyed toward the adhesive application position; (2) Stop the cooling means when applying adhesive to a sheet bundle conveyed to the adhesive application; and (3) Restart the cooling means after the adhesive has been applied to the sheet bundle at the adhesive application position.

The bookbinding apparatus according to the present invention is equipped with a sheet conveyance path that sequentially conveys sheets; a stacking tray means that stacks and stores in a bundle sheets conveyed from the sheet conveyance path; and an adhesive application position and cover sheet binding position in that order. Further equipped are a bookbinding path that conveys a sheet from the stacking tray means; a glue container that stores hot-melt adhesive disposed in the adhesive application position; an apparatus casing that houses the glue container; a cooling means disposed in the apparatus casing that cools the sheet bundle at the cover sheet binding position; and a control means that starts and stops operation of the cooling means. The control means stops the cooling means when adhesive is being applied to the sheet bundle by the applicator roll, and starts the cooling means after the adhesive has been applied by the applicator roll.

According to the invention, cooling means cools the sheet bundle after the cover sheet binding process inside the apparatus casing installed with a glue container for a glue such as hot-melt adhesive. Because the cooling means is stopped while the adhesive is being applied to the sheet bundle, and started thereafter, the following effects are attained. For example, the cooling means, such as a cooling fan or the like, cools the inside of the apparatus after adhesive is applied to the sheet bundle and the cover sheet has been bonded thereto. This solves the problem of applied adhesive solidifying prior to the cover sheet being bonded to the sheet bundle, and makes it possible for the cooling means to solidify adhesive in a short amount of time after the cover sheet has been bonded to the sheet bundle.

Also, it is possible to stably control the temperatures of the sheet and adhesive and prevent the temperature inside the apparatus from rising, by operating the cooling means when sheets are aligned, conveyed and set at the adhesive application position, stopping the cooling means when applying adhesive to the sheet bundle, and restarting the cooling means after the adhesive has been applied. In addition to this, the surface layer of the adhesive applied does not solidify while being applied, so it is possible to securely bind the cover sheet to the sheet bundle. Still further, the cover sheet can be solidified in a short amount of time after the binding process, thereby enabling an efficient binding process.

BRIEF DESCRIPTION OF THE SEVERAL VIEWS OF THE DRAWINGS

FIG. 4A shows the stacking of a sheet; FIG. 4B shows the adhesive application operation;

FIG. 5A shows a sheet bundle conveyed from an application position to a cover sheet binding position; FIG. 5B shows a cover sheet joined to the sheet bundle; FIG. 5C shows the cover sheet being folded; FIG. 5D shows the sheet bundle moving to a downstream side;

DETAILED DESCRIPTION OF THE INVENTION

Figure 1:
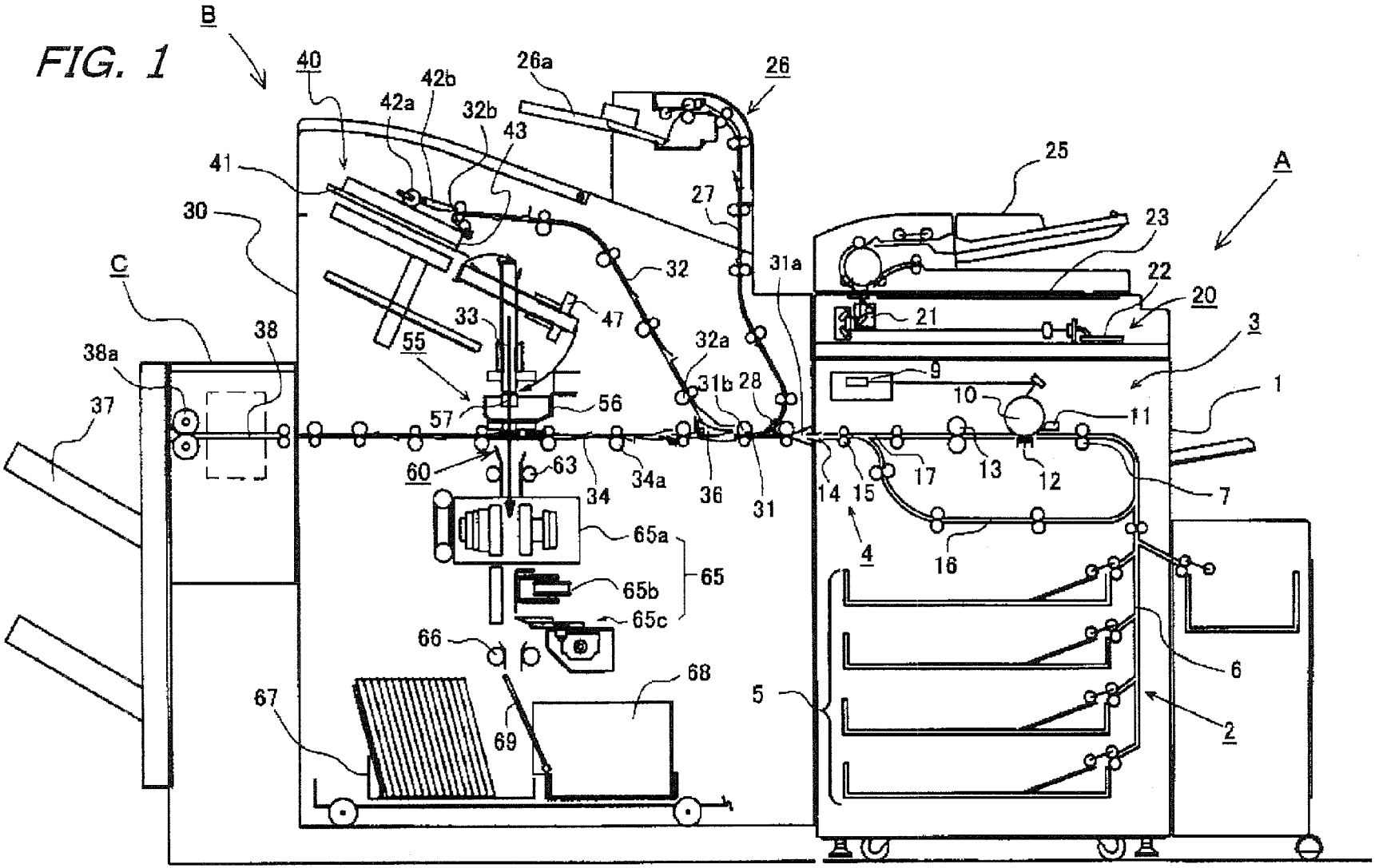
FIG. 1 is an explanatory view of the overall configuration of an image-forming apparatus equipped with a bookbinding apparatus installed with an adhesive applicator according to the present invention.
Figure 2:
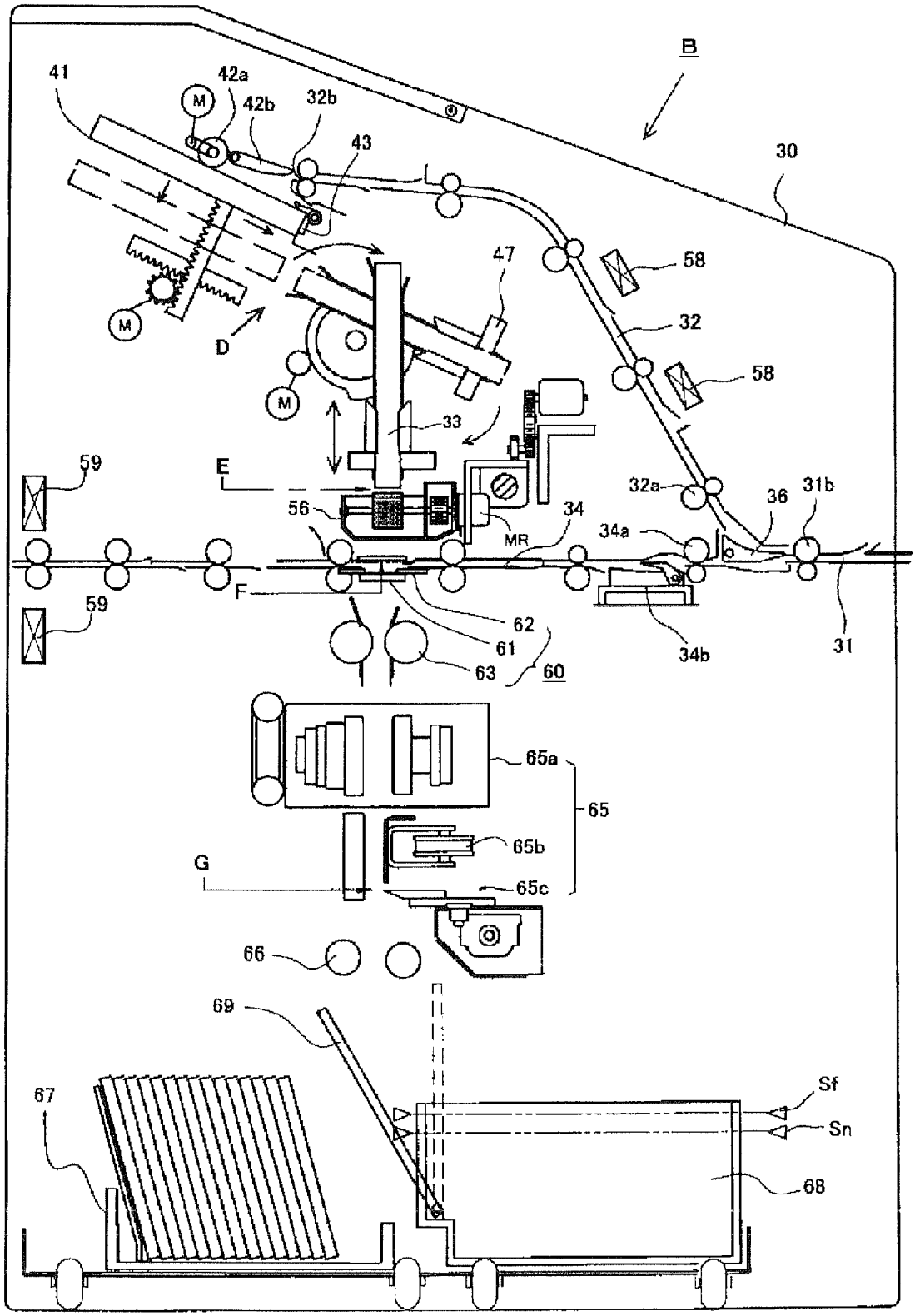
FIG. 2 is a detailed explanatory view of the bookbinding in the apparatus of FIG. 1.

A preferred embodiment of the present invention will now be explained with reference to the drawings provided. FIG. 1 is an explanatory view of a bookbinding apparatus according to the present invention and an image system that uses this; FIG. 2 is an explanatory view of the bookbinding apparatus.

The image-forming system shown in FIG. 1 is composed of an image-forming apparatus A that sequentially prints sheets; a bookbinding apparatus B equipped at a downstream side of this image-forming apparatus A; and a finisher apparatus C disposed downstream of the bookbinding apparatus B. Sheets formed with images at the image-forming apparatus A undergo the bookbinding process at the bookbinding apparatus B. Sheets that do not require bookbinding pass through the bookbinding apparatus B and are finished at the finishing apparatus C.

Initially, the image-forming apparatus A can employ a variety of structures, such a copier, printer or printing machine. The image-forming apparatus A is installed in the casing 1 with a sheet feeder 2, a printing unit 3, a discharge unit 4, and a control unit. A plurality of cassettes 5 that correspond to sheet sizes is disposed in the sheet feeder 2; Sheets of the sizes instructed by the control unit are kicked out and fed to the sheet feeding path 6. A registration roller 7 is disposed in the sheet feeding path 6 to feed a sheet to the downstream printing unit 3 at a predetermined timing after the leading edge of the sheet has been aligned.

A static-electric drum 10 is disposed in the printing unit 3. A print head 9, developer 11, and transfer charger 12 and the like are disposed around this static-electric drum The print head 9 is composed of a laser emitter, for example. A latent image is formed on the static-electric drum 10; the developer 11 adheres toner ink to the latent image; the image is printed onto the sheet by the transfer charger 12. The image is fixed to the printed sheet by a fuser 13, and is then conveyed out to a discharge path 17. A discharge outlet 14 formed in the casing 1, and a discharge roller 15 are disposed in the discharge unit 4. Note that 16 is a cycling path. Printed sheets from the discharge path 17 are turned over from front to back at a switchback path, then fed again to the registration roller 7 so that images can be formed on the backside of the printed sheet. In this way, sheets printed with images on the front side or on both sides can be discharged from the discharge outlet 14 by the discharge roller 15.

Note that the symbol 20 in the drawings represents a scanner unit. This optically reads images on an original to be printed by print head 9. The structure is widely known to be composed of a platen 23 where an original sheet is placed; a scanning carriage 21 that travels along the platen 23 to scan the original image; and an optical reading means (such as a CCD device) that photo-electrically converts the optical image from the carriage 21. The drawing shows a document feeder 25 that automatically feeds original sheets is installed above the platen 23.

The following will now explain the bookbinding apparatus B that is attached to the image-forming apparatus A described above. The bookbinding apparatus B is composed of a stacking unit 40 (hereinafter referred to as the stacking tray 41) that stacks sheets in a bundle and aligns their edges in the casing 30; an adhesive application means 55 that applies adhesive to the sheet bundle conveyed from the stacking tray 41; and cover sheet binding means 60 that binds a cover sheet to a sheet bundle that has been applied with adhesive. A sheet convey-in path 32 (hereinafter referred to as an inner-sheet conveyance path) is disposed at an upstream side of the stacking tray 41, and a bookbinding path 33 is disposed at a downstream side thereof. The stacking unit 40 is composed of the stacking tray 41 disposed in a substantially horizontal direction and stacks and stores printed sheets from a discharge outlet 32*b* of the inner-sheet conveyance path 32.

A forward and reverse rotating roller 42*a* and convey-in guide 42*b* are equipped above the stacking tray 41. The convey-in guide 42*b* guides the printed sheet from the discharge outlet 32*b* to above the stacking tray 41, and the forward and reverse rotating roller 42*a* stores the printed sheet. The forward and reverse rotating roller 42*a* stores the printed sheet in the stacking tray 41 with a forward rotation. When rotated in reverse, the trailing edge of the sheet is pushed against an aligning member 43 disposed at the trailing edge of the tray (the right edge of FIG. 1) to become aligned. An aligning means, not shown, is equipped on the stacking tray 41 to align both edges of the printed sheet stored in the tray to reference positions. With this configuration, printed sheets conveyed from the inner-sheet conveyance path 32 are sequentially stacked in the stacking tray 41 and aligned into a bundle shape.

Explanation of Conveyance Paths

The following will explain each sheet conveyance path. In the casing 30, a convey-in path 31 having a conveyance in inlet 31*a* connected to the discharge outlet 14 of the image-forming apparatus A, and a cover sheet conveyance path 34 connected to the convey-in path 31 are disposed to intersect the apparatus. A first sheet conveyance path is composed to convey a sheet in a substantially horizontal direct by intersecting the apparatus with the convey-in path 31 and the cover sheet conveyance path 34. Also, the inner-sheet conveyance path 32 that guides a sheet to the stacking unit 40 (stacking tray 41) is connected to the convey-in path 31 interposed by a path switching flapper 36 to convey a sheet from the conveyance in inlet 31*a* to the stacking tray 41.

A bookbinding path 33 that longitudinally intersects the apparatus at a downstream side to convey the sheet bundle in a substantially longitudinal direction is equipped on the stacking tray 41. A second sheet conveyance path (hereinafter referred to as a bookbinding path) and the first sheet conveyance path (hereinafter referred to as a cover sheet conveyance path) that compose the bookbinding path 33 mutually intersect. The cover sheet binding means 60, described below, is disposed in the intersection. The convey-in path 31 configured as described above is connected to the discharge outlet 14 of the image-forming apparatus A described above, to receive printed sheets from the image-forming apparatus A. Printed sheets printed (the inner sheets) with information and a sheet (hereinafter referred to as a cover sheet) printed with a title for use as the cover sheet are conveyed out from the image-forming apparatus A. The convey-in path 31 is separated into the inner-sheet conveyance path 32 and the cover sheet conveyance path 34; these are interposed by a path switching flapper 36. This selects the path to convey each printed sheet.

On the other hand, an inserter device 26 is connected to the convey-in path 31. This is configured to separate one cover sheet that will not be printed at the image-forming apparatus A at a time from feeder tray 26*a* and feed it to the convey-in path 31. The inserter device 26 is equipped with one or a plurality of a feeder tray 26*a*. Feeding means that separates stacked sheets into single sheets, and sheet feeding path 27 downstream of the feeding means are disposed on the leading edge of the tray. The sheet feeding path 27 is connected to the convey-in path 31 interposed by a path switching piece 28. The conveyance roller 31*b* is disposed in the convey-in path 31; the conveyance roller 32*a* is disposed in the inner-sheet conveyance path 32; the gripping conveyance means 47, the turntable unit 65*a*, described below, and the conveyance roller 66 are disposed in the bookbinding path 33. A conveyance roller 34*a* is disposed in the cover sheet conveyance path 34 and a conveyance roller 38*a* is disposed in a finishing path 38; these are connected to a drive motor.

The stacking tray 41 is connected to the inner-sheet conveyance path 32 and the bookbinding path 33 is equipped at a downstream side of the stacking tray 41. The bookbinding process is performed in the bookbinding path 33 while inner sheets stacked in a bundle (hereinafter referred to as a sheet bundle) are sequentially fed. The bookbinding path 33 shown in the drawings is arranged in a substantially longitudinal direction. This is arranged downstream in the order of a sheet bundle posture deviation position D; an adhesive application predetermined position E; a cover sheet binding position F; and a cutting process position G. The cover sheet conveyance path 34 is arranged to intersect the cover sheet binding position F. A cover sheet is fed to the cover sheet binding position F.

An adhesive application means 55 is disposed in the adhesive application position E in the bookbinding path 33. The adhesive application means 55 is composed of a glue container 56 to store hot-melt adhesive; an applicator roll 57; and a roller rotating motor MR. The applicator roll 57 and roller rotating motor MR are incorporated into the glue container 56. The glue container 56 is supported to move along the sheet bundle. By the glue container 56 reciprocating movement in front to back directions of FIG. 1 along the length direction of the sheet bundle, adhesive is applied to an edge of the sheet bundle.

The gripping conveyance means 47 that move the sheet from the stacking tray 41 to the adhesive application position E is disposed in the bookbinding path 33. The gripping conveyance means 47 turns the sheet bundle stacked on the stacking tray 41 from a horizontal posture to a vertical posture, then conveys the sheet bundle to the adhesive application position E by conveying it along the sp33 disposed in a substantially vertical direction. For that reason, the stacking tray 41 moves from a stacking position (solid lines in FIG. 2) to the hand-over position (dashed line in FIG. 2), and hands over the sheet bundle to the gripping conveyance means 47 prepared at this hand-over position.

The cover sheet binding means 60 is disposed in the cover sheet binding position F of the bookbinding path 33. The cover sheet conveyance path 34 is disposed to intersect the cover sheet binding position F. A cover sheet is fed from the cover sheet conveyance path 34. At the cover sheet binding position F, the cover sheet and the sheet bundle fed from the adhesive application position E are joined together to form a booklet. For that reason, a back-support plate 61 that supports the cover sheet; a folding plates 62 that press forms the joint (backside) of the cover sheet and sheet bundle; and folding rollers 63 are provided in the cover sheet binding position F. The cover sheet binding means 60 is composed of the back-support plate 61, the folding plates 62; the folding rollers 63, and the cover sheet binding means 60; these perform the bookbinding process with the procedures shown in FIGS. 5A to 5D.

Figure 5A:
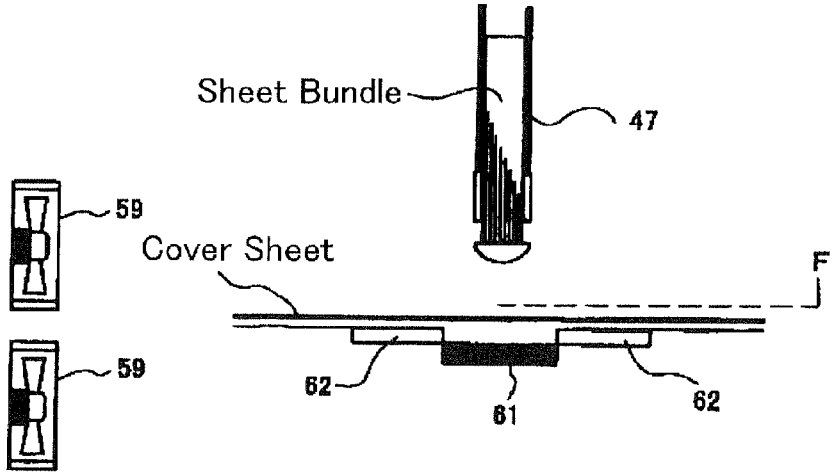
FIGS. 5A, 5B, 5C, and 5D are explanatory views of the operation of the bookbinding process in the apparatus of FIG. 2.
Figure 5B:
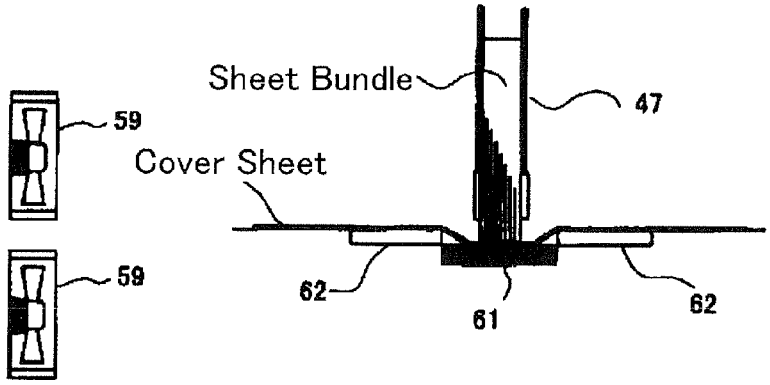
Figure 5C:
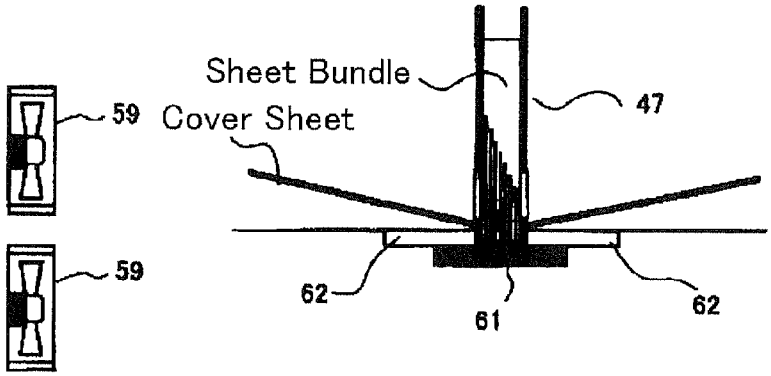
Figure 5D:
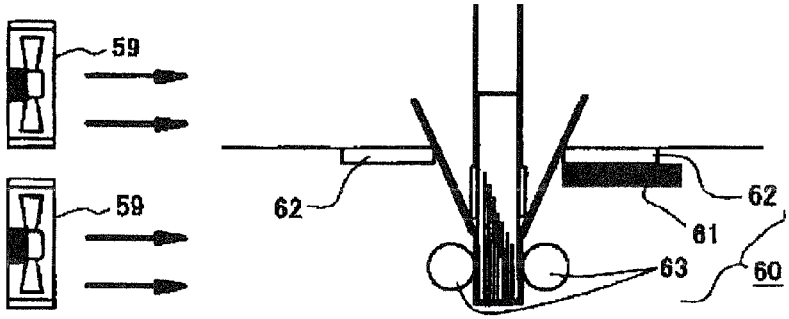

FIG. 5A shows the state prior to the cover sheet and sheet bundle being joined. The sheet bundle is being moved by the gripping conveyance means 47 in a downward direction of the drawing. In FIG. 5B, the sheet bundle touches the center of the cover sheet while it is being supported by the back-support plate 61. The folding plates 62 is composed of a pair of right and left block members that move from a retracted position retracted from the bookbinding path 33 and an operating position where they press together in the bookbinding path 33. As shown in FIG. 5C, when these move from the retracted position to the operating position, they press-form the backside of the sheet bundle and the cover sheet. After the booklet cover is formed, the back-support plate 61 and folding plates 62 retract from the bookbinding path 33. When the sheet bundle is moved downstream by the gripping conveyance means 47 in this state, the folding rollers 63 fold the sheet bundle into the cover sheet. (State shown in FIG. 5D) In this way the sheet bundle (inner sheets) are covered by the cover sheet to form the booklet.

Cutting means 65 is disposed in the cutting process position G positioned downstream of the folding rollers 63. The cutting means 65 is composed of a turntable unit 65*a* that turns the sheet bundle upside down; a cutting edge press unit 65*b* that pressingly supports the edges of the sheet bundle to be cut; and the cutting blade unit 65*c*. The turntable unit 65*a* is configured to revolve while nipping the sheet bundle fed from the folding rollers 63, and to set the sheet bundle at the cutting process position G at the same time. The cutting edge press unit 65*b* is equipped with a pressing member movable in an orthogonal direction to the bookbinding path 33 to pressingly support the edges of the sheet bundle to be cut. The cutting blade unit 65*c* configured to pressingly hold the sheet bundle is composed of a flat-edged shape cutting blade, a blade bearing member that opposes the cutting blade sandwiching the sheet bundle, and the cutter motor that drives the cutting blade.

The cutting means 65 cuts a predetermined amount around the edges, excluding the spine of the sheet bundle that has been made into a booklet, to align the edges. A discharge roller 66 and storage stacker 67 are disposed downstream of the cutting process position G. This storage stacker 67 stores sheet bundles in an inverted manner as shown in the drawing. A full detection sensor, shown in FIG. 2, is disposed in the storage stacker 67. This detects when the sheet bundles stacked in the storage stacker 67 are full, and issues a prompt to the operator to remove the sheet bundles.

A cuttings collection box 68 is disposed parallel to the storage stacker 67 below the cutting process position G to store paper cuttings generated by the cutting blade. For that reason, a stopper means 69 is equipped directly below the cutting process position G. The stopper means 69 slides to the left and right of FIG. 2 by a drive motor, not shown. When the sheet bundle is being cut, this is positioned directly below the cutting process position G to guide paper cuttings into the cuttings collection box 68, and after the cutting of the sheet bundle is completed, this retracts from the cutting process position G to enable the sheet bundle to be stored in the storage stacker 67. A full detection sensor Software and near-full sensor Sn are disposed inside the cuttings collection box 68 to detect the amount of paper cuttings that have been stored. So that the box does not become full while cutting the sheet bundle, for example this near-full sensor Sn is disposed to detect a state where it is possible to store the equivalent of one time to cut the edges of the sheet bundle.

The finisher C is arranged in the bookbinding apparatus B. The finishing path 38 is equipped to be connected to cover sheet conveyance path 34 (first sheet conveyance path) for the finisher C and a finisher, such as a staple unit, punch unit, and stamp unit or the like, is disposed in the finishing path 38. This receives printed sheets from the image-forming apparatus A via the cover sheet conveyance path 34 and are stapled, punched or applied with a marking, then conveyed out to the discharge tray 37. It is also possible to not apply any finishing process on printed sheets and to store them in the discharge tray 37 directly from the image-forming apparatus A.

Figure 3:
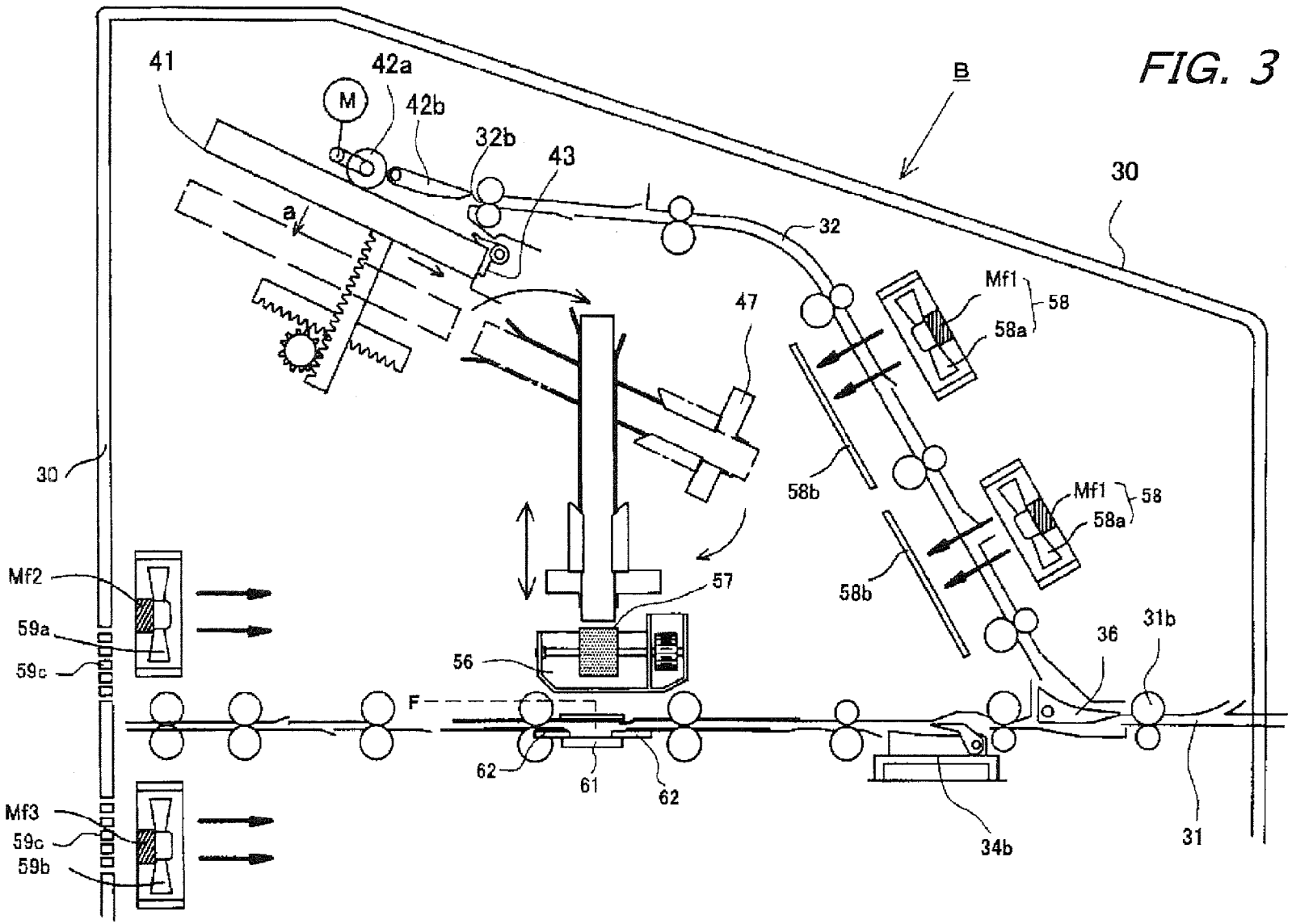
FIG. 3 is an explanatory view of the arrangement of the cooling means in the apparatus of FIG. 2.

In the configuration described above, the present invention provides a cooling means that cools the ambient temperature inside the apparatus. A feature of the present invention is to stop this cooling means while adhesive is being applied to the sheet bundle, and to operate it after the adhesive has been applied. Cooling means 58 and 59 are disposed in the casing 30 installed with the glue container 56 as shown in FIG. 3. The configuration will be described in detail below. The cooling means 58 is disposed to cool the sheets conveyed inside the inner-sheet conveyance path 32, and the cooling means 59 is disposed to cool the cover sheet binding position F.

Initially, sheets formed with images at the image-forming apparatus A are conveyed to the inner-sheet conveyance path 32 and are stacked in the downstream stacking tray 41. This sheet is heated when the formed image is fixed thereto and is conveyed at a high temperature. If stacked in a bundle without being cooled, the temperature can become quite high. When hot-melt adhesive is applied to a sheet bundle that has been exposed to high temperatures, an excessive amount of adhesive will become infused between the leaves of the booklet causing a poor binding, or the adhesive can drip and get into the apparatus. The cooling means 58 is equipped in the inner-sheet conveyance path 32 to cool the sheet in the path leading from the image-forming apparatus A to the stacking tray 41. The drawings show a cooling fan 58*a* as an example of the cooling means 58. A fan motor Mf1 is installed to rotatingly drive this cooling fan 58*a*. The cooling fan 58*a* generates an air current in the direction of the arrows in the drawing inside the casing 30 and this cools the sheet passing over the inner-sheet conveyance path 32 to room temperature. Note that 58*b* in the drawing represents a shielding plate (wind-blocking wall) that blocks the wind, arranged between the cooling fans 58*a* and the glue container 56 to prevent the air currents generated by the cooling fans 58*a* from negatively affecting the temperature of the container.

The cooling means 59 is composed of the cooling fans 59*a* and 59*b* that cool the cover sheet binding position F arranged at a downstream side of the glue container 56, as described above; fan motors Mf2 and Mf3 are installed for both. This cooling means 59 has the effect of maintaining the temperature inside the apparatus where the glue container 56 is disposed at a constant temperature, and the effect of cooling the adhesive applied to the sheet bundle at the cover sheet binding position F downstream of the glue container 56. Specifically, if the hot-melt adhesive stored in the glue container 56 has risen to a temperature of approximately 150° C., it will liquefy. The adhesive temperature must be controlled to a predetermined temperature because it is affected by the ambient temperature and that affects the adhesion.

Specifically, if adhesive is applied to a 30° C. sheet bundle and a 50° C. sheet bundle, the permeation of the adhesive or the thickness of the adhesive layer will differ, making it impossible to apply covers that are consistent. These are configured to blow cool air to maintain the ambient temperature inside the apparatus where the glue container 56 is installed at a constant. The sheet bundle applied with adhesive is provided a cover sheet at the downstream cover sheet binding position F, but it is preferable that the adhesive cool and solidify quickly after the cover is mounted. For that purpose, the outside-air flow holes 59*c* and cooling fans 59*a* and 59*b* are disposed in the casing 30.

The present invention provides the following controls of the cooling means 59 that cools the adhesive application position E and the cover sheet binding position F. (1) While the sheets are stacked in the stacking tray 41, and while the stacked sheet bundle is being fed to and set at the adhesive application position E, the cooling means 58 and 59 operate to cool the temperature inside the apparatus and the temperature of the sheets. (2) While the sheet bundle is being applied with adhesive at the adhesive application position E, at least the cooling fans 59 are stopped. In this case, the cooling fans 58 are stopped or continue operating to cool subsequent sheets. (3) After adhesive is dispensed to the sheet bundle, the cooling fans 59 operate. In this case, after the sheet bundle applied with adhesive and the cover sheet are joined, it is preferred that the cooling fans 59 operate.

The cooling means 59 is controlled by a control CPU (control means) that executes the bookbinding operation, for example. This blows air during the process to apply adhesive to the sheet bundle to solidify the surface of the adhesive layer.

Figure 6:
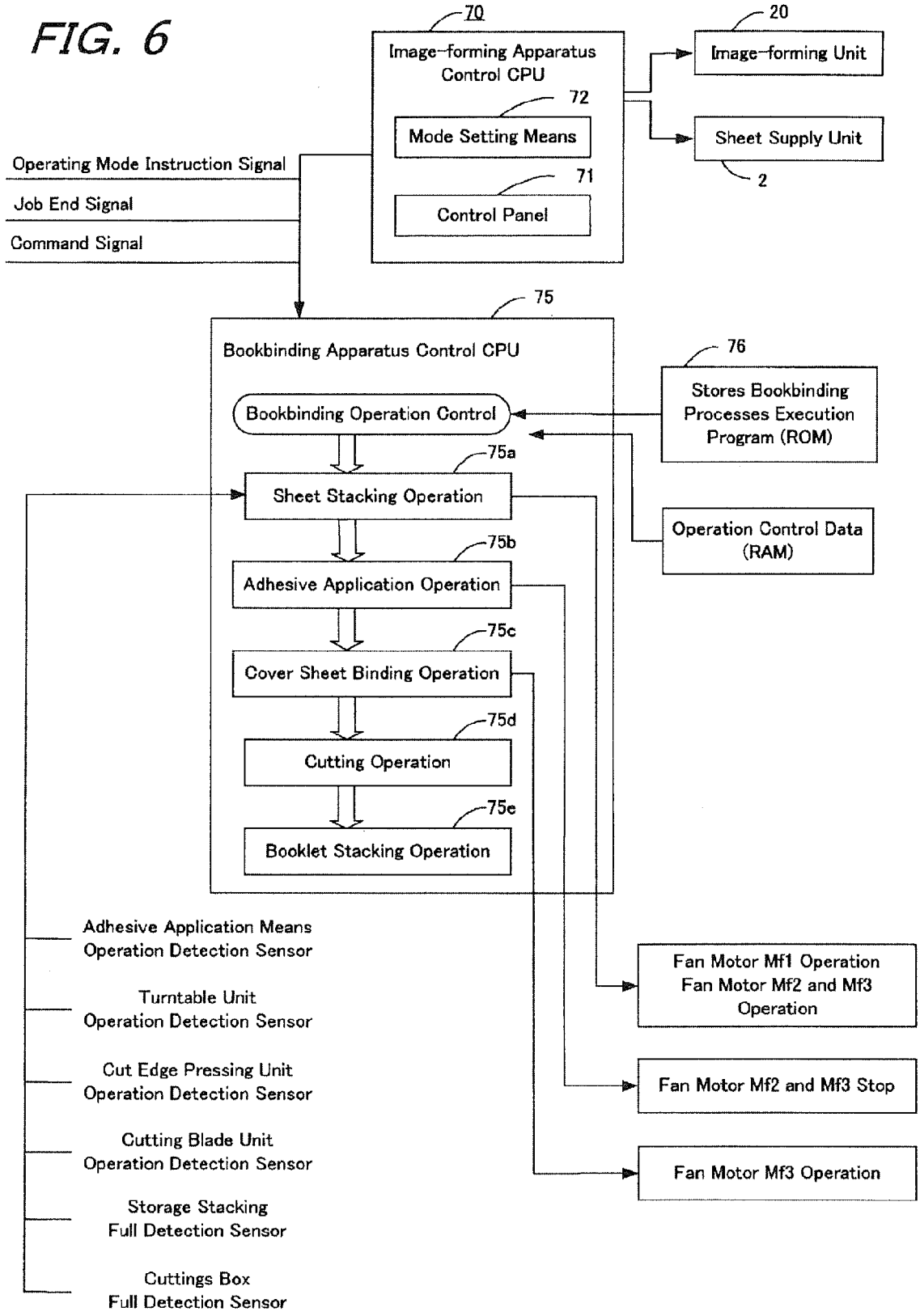
FIG. 6 is a block diagram of a configuration of a control unit means in the apparatus of FIG. 2.

The configuration of the control means will now be explained with reference to FIG. 6. FIG. 6 is a control block diagram. As shown in FIG. 1, in the system that connects the image forming apparatus A and the bookmaking apparatus B, the control panel 71 and mode selection means 72 are connected to the control CPU70 provided on the image forming apparatus A. A control CPU75 is equipped in the control unit of the bookbinding apparatus B. This control CPU75 calls up a bookbinding execution program from the ROM76 and executes each process in the bookbinding path 33. This control CPU75 receives a finishing mode instruction signal, job end signal and other information and command signals required in the bookbinding process from the control CPU70 of the image-forming apparatus A.

Figure 7:
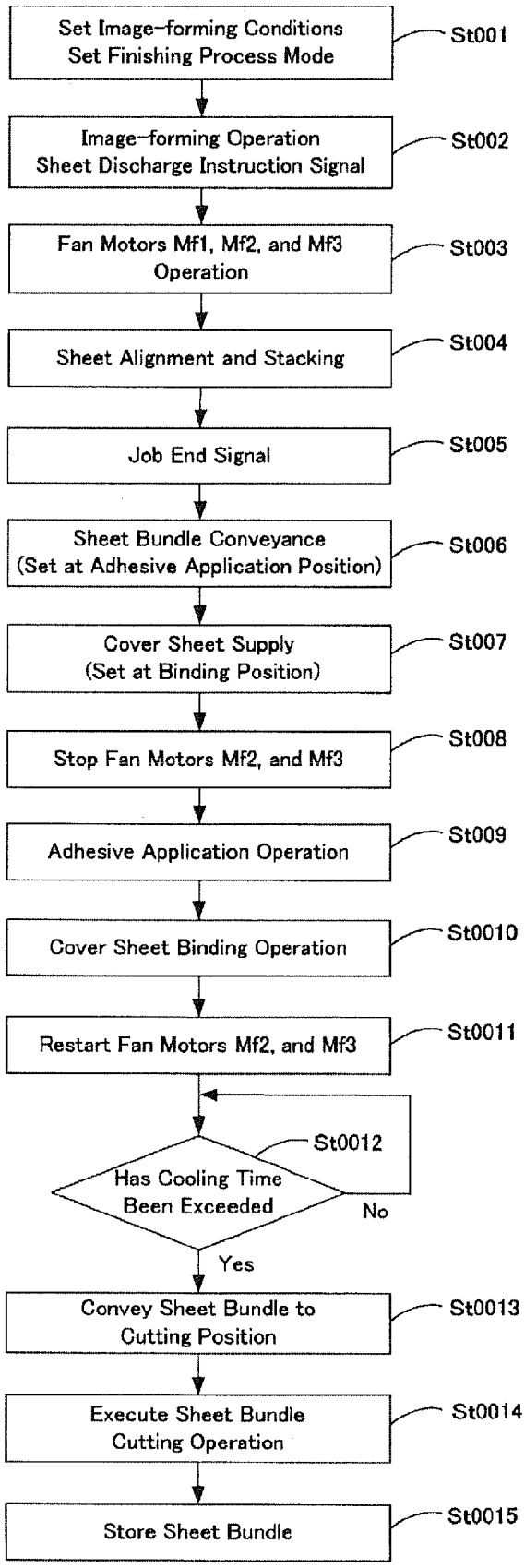
FIG. 7 is a flowchart block diagram of operating procedures of the bookbinding process in the apparatus of FIG. 2.

The control CPU75 is configured to read the bookbinding processing program from the ROM76, and to execute each of the operations of the sheet stacking operation 75*a*, the adhesive application operation 75*b*, the cover sheet binding operation 75*c*, the cutting operation 75*d*, and the booklet stacking operation 75*e*. It is also configured to determined operating states using signals from the sensors disposed in each of the operating means described above and to control the cooling means 58 fan motor Mf1, and cooling means 59 fan motors Mf2, and Mf3. The bookbinding operation by the control means (control CPU) 75 will now be explained with reference to the flowchart of FIG. 7.

Image forming conditions and a finishing mode are set (St001) using the control panel 71 on the image-forming apparatus A. "Print-out mode," "Bookbinding mode," "Staple mode," "Marking mode," "Hole-punching mode," and "Jog mode" can be set as the finishing mode, for example. In the print-out mode, a sheet formed with an image is not formed into a booklet or finished. It is conveyed out to the discharge tray 37 (equipped on the finisher C in the drawings) and stored.

With the bookbinding mode, sheets formed images are aligned and stacked, then joined with a cover sheet and stored in the storage stacker 67. Also, in the staple mode, sheets formed with images are stapled by a stapling unit equipped in the finisher C; in the marking mode, a mark is applied; in the hole-punching mode, holes are punched in the sheets; and in the jog mode, sheets are sorted. Each of these modes is executed by the finisher C, and then the finished sheets are stored in the discharge tray 37.

Figure 4A:
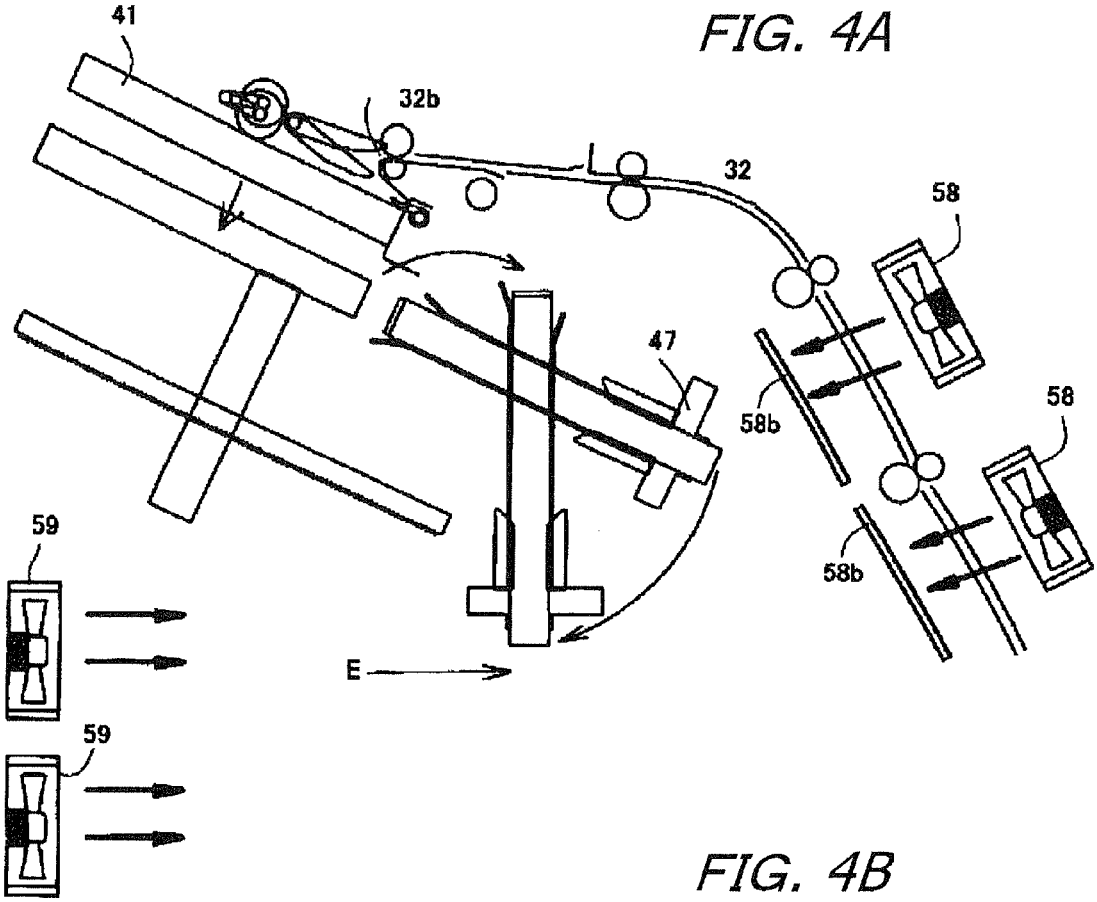
FIGS. 4A and 4B are explanatory views of the operations of the bookbinding in the apparatus of FIG. 2.

When the bookbinding mode is selected, an image forming operation is executed by the image-forming apparatus A, and the sheet formed with images is conveyed out from the discharge outlet 14. (St002) When a discharge instruction signal is received from the image-forming apparatus A, the control CPU75 of the bookbinding apparatus B drives the conveyor motor of the inner-sheet conveyance path 32 (the sheet conveyance path) to convey in the sheet from the conveyance in inlet 31*a* and discharge it from the discharge outlet 32*b*. The fan motors Mf1, Mf2, and Mf3 are operated by the discharge instruction signal at this time, so the cooling fans 58*a* of the fan motor Mf2 cool the sheets being conveyed in the inner-sheet conveyance path 32. (St003) The fan motors Mf2 and Mf3 operate the cooling fans 59*a* and 59*b* to start blowing air to maintain a constant temperature inside the casing 30. Sheets fed to the discharge outlet 32*b* are conveyed into the stacking tray 41 and are aligned at the aligning member 43 for stacking. (St004) Next, when the job end signal is received from the image-forming apparatus A (St005), the control CPU75 conveys the sheet bundle stacked in the tray to the downstream bookbinding path 33 (St006) using the gripping conveyance means 47. To convey the sheet bundle, the stacking tray 41 is lowered from the stacking position to the conveying position, as shown in FIG. 4A. At that position, the gripping conveyance means 47 grips the sheet bundle. Next, the gripping conveyance means 47 rotates the sheet bundle substantially 90° so that the sheet bundle changes from a horizontal orientation to a vertical orientation. After the sheet bundle orientation has been changed, the gripping conveyance means 47 conveys the sheet bundle so that its bottom edge is positioned at the adhesive application position E. During the operation depicted in FIG. 4A, the cooling means 59 continues to blow air inside the casing by the operation of the fan motors Mf2, and Mf3 to maintain a constant temperature inside the apparatus.

Next, around the time when the control CPU75 conveys the sheet bundle to the adhesive application position E, it conveys a cover sheet from the cover sheet conveyance path 34 and sets it at the cover sheet binding position F. (St007) Note that the cover sheet can be fed from the image-forming apparatus A or from the inserter device 26. Next, the control CPU75 measures the timing for the sheet bundle to be set at the adhesive application position E and stops the fan motors Mf2 and Mf3 around that time so that the cooling means 59 is not operating. (St008) It is acceptable to have the cooling means 59 stop prior to the adhesive application operation that follows.

Figure 4B:
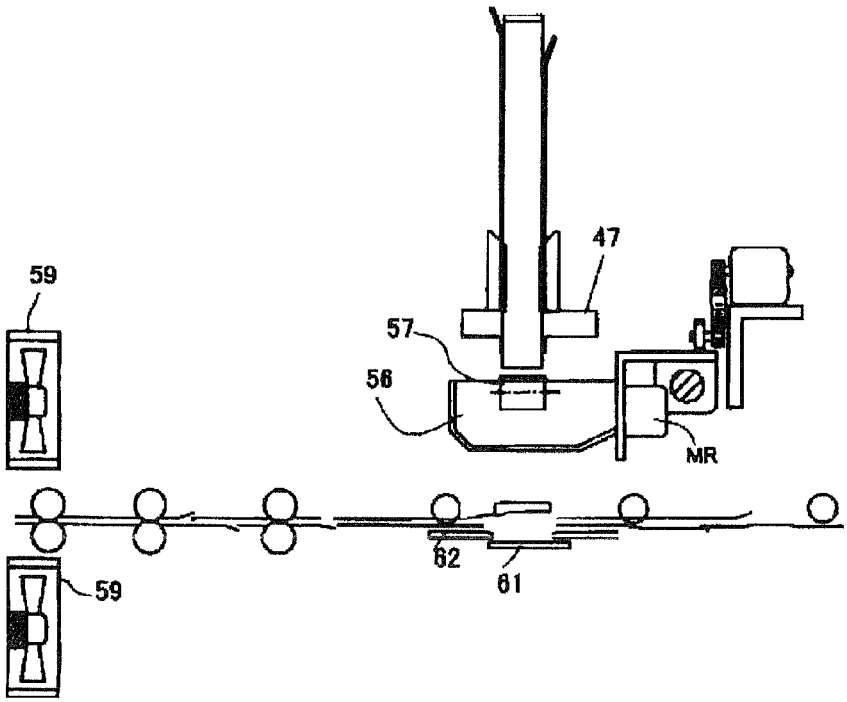

Next, the control CPU75 executes the adhesive application operation while the cooling means 59 is stopped. This state is shown in FIG. 4B, but the control CPU75 stops the fan motors Mf2 and Mf3 and moves the glue container 56 to the front and back sides of the drawing along the bottom edge of the sheet bundle. (St009) At this time, the applicator roll 57 is rotated by the roller rotating motor MR to apply adhesive to the bottom edge of the sheet bundle. Next, the control CPU75 conveys the sheet bundle applied with adhesive to the downstream cover sheet binding position F as shown in FIG. 5A. The sheet bundle is joined to the cover sheet at the cover sheet binding position F in an upside-down T configuration. At this time, the cover sheet is supported by the back-support plate 61 as shown in FIG. 5B. In this state, the folding plates 62 sandwich the sheet bundle as shown in FIG. 5C to press the cover sheet and fold it over the spine of the sheet bundle. (St010)

Next, the control CPU75 restarts the fan motors Mf2 and Mf3 to operate the cooling means 59. (St011) The cooling means 59 act to cool the folded cover sheet and sheet bundle to harden the adhesive. Then, the control CPU75 waits for a predetermined cooling time to pass. (St012) After the predetermined cooling time has passed, the control CPU75 retracts the back-support plate 61 and the folding plates 62 from the bookbinding path 33 and rotatingly drives the folding rollers 63 to convey the sheet bundle to the downstream cutting process position G. (St013) This cooling time is to prevent adhesive residue from adhering to the cutting blade when the adhesive has not adequately solidified and the covered sheet bundle is being cut at the downstream cutting position. At the same time, this cooling time prevents the booklet from being pulled apart (in other words, the binding being ruined) when it is being cut. The drawing shows the cooling times are varied according to the thicknesses of the sheet bundles. For example, when trimming three sides of the sheet bundle, the number of sheets Sa and the cooling time Ta are set to have the following relationship.

The cooling time Ta is set to be longer in proportion to the thickness of the sheet bundle in the following way. When Sa=0 to a number of sheets: Ta=X1 seconds; when Sa=(a+1) to b (b>a) number of sheets: Ta=X2 (X2>X3) seconds; when Sa=(b+1) to c (c>b) number of sheets: Ta=X3 (X3>X2) seconds.

After the cooling time, the control CPU75 operates the cutting means 65 to trip the top, the base and thumb-edge portions of the sheet bundle for their alignment. (St014) After this cutting operation on the sheet bundle is completed, the control CPU75 stores the finished sheet bundle in the storage stacker 67. (St015)

As described above, the present invention solves the problem of adhesive hardening prior to binding a cover sheet thereto by cooling the temperature inside the apparatus after the cover sheet has been bound to the sheet bundle, and shortens the adhesive hardening time using the cooling means to cool the adhesive after the sheet bundle and cover sheet have been joined.

Furthermore, this prevents the temperature inside of the apparatus from rising, and stably controls the sheet temperature and adhesive temperature. In addition to this, the surface layer of the adhesive applied does not solidify while being applied, so it is possible to securely bind the cover sheet. Still further, the cover sheet can be solidified and glued after binding in a short amount of time, enabling the binding process to be efficient.

This application claims priority rights from Japanese Pat. App. No. 2006-239579, which is herein incorporated by reference.

What is claimed is:

1. An adhesive applicator, disposed in a location for glue application within a path along which sheet sheaves are conveyed, for performing cover-sheet binding processes with a downstream cover-sheet binding means, the applicator comprising:

a glue container for receiving hot-melt adhesive;

an applicator roll disposed inside said glue container;

an apparatus casing internally adapted with said glue container;

cooling means disposed alongside a glue application position inside said casing, for post-glue-application cooling of sheet sheaves; and control means for actuating and halting said cooling means, said control means being configured to (1) cool the apparatus casing interior by actuating said cooling means when a sheet sheaf is conveyed toward the glue application position;

(2) halt said cooling means when adhesive is being applied to said sheet sheaf having been conveyed into the adhesive application position; and (3) reactivate said cooling means after adhesive has been applied to said sheet sheaf in the adhesive application position.

2. A bookmaking apparatus comprising:

a sheet convey-in path for sequentially conveying-in sheets;

stacking tray means for stacking and stowing into sheaves sheets conveyed out from the sheet conveyance path;

a bookbinding path provided with a location for glue application and a cover-sheet binding position, in that order, said bookbinding path for conveying sheets from said stacking tray means;

a glue container disposed in the glue application position, for receiving hot-melt adhesive;

an applicator roll disposed in said glue container;

an apparatus casing internally adapted with said glue container;

a first cooling means disposed alongside a glue application position inside the casing, for post-glue-application cooling of sheet bundles in at least either the glue application position or the cover sheet binding position; and control means for actuating and halting said first cooling means, said control means being configured to (1) actuate said first cooling means while a sheet sheaf is conveyed from the sheet convey-in path to said stacking tray means, and while it is conveyed from said stacking tray means to the glue application position;

(2) halt said first cooling means when adhesive is being applied to said sheet sheaf having been conveyed into the adhesive application position; and (3) reactivate said first cooling means after adhesive has been applied to said sheet sheaf in the adhesive application position.

3. The bookmaking apparatus according to claim 2, further comprising:

blower means for cooling sheets during conveyance in the sheet convey-in path; and a shielding plate arranged between said blower means and said glue container, for blocking airflow from said blower means.

4. The bookbinding apparatus according to claim 2, said first cooling means comprising:

a blower fan; and a fan motor for driving said blower fan; wherein said control means controls power supplied to said fan motor.

5. An image forming apparatus comprising:

an image forming unit having image forming means for forming images onto sheets; and a bookbinding unit according to claim 2, for collating sheets from said image-forming unit into sheaves, and applying adhesive to a sheaf and binding it together with a cover sheet.

6. The image-forming apparatus according to claim 5, wherein the bookbinding unit is equipped with cutting means for trimming a predetermined extent of the margin, excluding the binding spine portion, of a bound-together sheet sheaf and cover sheet.

7. The bookmaking apparatus according to claim 2, further comprising a second cooling means for post-glue-application cooling of sheet bundles conveyed from the glue application position, said second cooling means being disposed downstream, in the sheet conveyance direction, of the glue application position, and to the side of the glue application position.

* * * * *